US005204403A

United States Patent [19]

Furuta et al.

[11] Patent Number: 5,204,403

[45] Date of Patent: Apr. 20, 1993

[54] MOISTURE PERMEABLE AND WATERPROOF COATED FABRIC AND METHOD FOR MANUFACTURING SAME

[75] Inventors: Tsunekatsu Furuta, Ohtsu; Ken'ichi Kamemaru; Kiyoshi Nakagawa, both of Uji, all of Japan

[73] Assignee: Unitika Ltd., Hyogo, Japan

[21] Appl. No.: 909,157

[22] Filed: Jul. 6, 1992

[30] Foreign Application Priority Data

Jul. 15, 1991 [JP] Japan ..... 3-201310
Sep. 11, 1991 [JP] Japan ..... 3-260971
Feb. 6, 1992 [JP] Japan ..... 4-056899

[51] Int. Cl.[5] ..... C08L 75/04

[52] U.S. Cl. ..... 324/493; 524/590; 524/591; 521/82; 521/91; 427/244; 427/245; 427/246; 428/317.9

[58] Field of Search ..... 524/493, 590, 591; 521/82, 91; 427/244, 245, 246; 428/317.9

[56] References Cited

U.S. PATENT DOCUMENTS 4,476,276 10/1984 Gasper et al. ..... 524/493

*Primary Examiner*—Maurice J. Welsh
*Attorney, Agent, or Firm*—Joseph W. Farley

[57] ABSTRACT

A water-vapor permeable, waterproof coated fabric having a fibrous base fabric, and a porous film coated on one side of the base fabric. The porous film comprises a synthetic polymer composed mainly of a polyurethane resin and inorganic fine particles having a mean particle diameter of not more than 0.1 μm. In the porous film, microcells intercommunicate in the thicknesswise direction of the film to form a honeycomb skin core structure having a diameter of 1 to 20 μm. The porous film has a multiplicity of micropores having a diameter of not more than 1 μm. The coated fabric has waterproof and water-vapor permeability characteristics sufficient to meet such performance characteristics required in various applications, such as rainwears, military garments, and sportswears.

9 Claims, 3 Drawing Sheets x1,000 x10,000 x1,000

MOISTURE PERMEABLE AND WATERPROOF COATED FABRIC AND METHOD FOR MANUFACTURING SAME

FIELD OF THE INVENTION

The present invention relates to a coated fabric having good permeability to water vapor and good waterproofness which is used in various apparel applications, such as rainwears and outer garments, and a method for manufacturing same.

BACKGROUND OF THE INVENTION

As is well known, there are two types of coated fabrics which can be produced by a wet or dry coating process, namely, one in which the resin coat is porous and the other in which the resin coat is non-porous. Generally, when the resin coat is porous, it may provide satisfactory water-vapor transmission but may not provide any sufficient degree of waterproofness. Conversely, when the resin coat is non-porous, it may exhibit good waterproofing performance but may not provide any good permeability to water vapor. For example, coated fabrics produced by a polyurethane resin wet coating process primarily have a high degree of waterproofness, but they have no sufficient permeability to water vapor; as such, it is a common practice to use in combination an anionic surface active agent, a nonionic surface active agent, a hydrophilic polymer, and the like in order to provide improved water-vapor permeability. However, coated fabrics resulting from such practice have no sufficient water vapor transmission and their waterproof performance is considerably lower than what it should be. Apparently, such practice has not been successful in meeting the necessary performance criteria in respect of both moisture permeability and waterproofness.

Recently, in an attempt to overcome such deficiencies, it has been proposed to form on the fibrous base fabric a porous, highly permeable resin coat, then a non-porous resin coat on the porous resin coat, thereby to provide both good water vaper transmission and good waterproofness. With such a method, however, it is only possible to provide a moisture permeability of the order of 5000–6000 g/m$^2$/24 hrs at best with respect to the porous, highly permeable resin coat, where a wet process is employed; therefore, even if the non-porous resin coat is applied thinly over the porous resin coat, the permeability of the coated fabric will be extremely low after all. In actuality, therefore, it has been impracticable to meet the requirements for both moisture permeability and waterproofness in a manner consistent with each other. Further, the foregoing approach is disadvantageous from the view point of processing cost in that coating must be effected in two operations.

In Japanese Patent Application Laid-Open Publication No. 58-4873 and Japanese Patent Publication No. 62-53632 are proposed processing methods for production of a water-vapor permeable, waterproof fabric wherein a polyurethane resin film is formed which consists mainly of silicon dioxide and includes porous particles having a mean particle diameter of 2–50 μm and a total pore volume of 0.2–5 ml/g, a water repellent having perfluoro alkyl groups being then applied to the coated fabric. In either of the methods, however, the permeability obtainable is of the order of 3000 g/m$^2$/24 hrs at best, which is far from being said to be sufficient.

In Japanese Patent Application Laid-Open Publication No. 2-251672, there is disclosed an invention which concerns a method for production of a polyester coated fabric including a resin coat having fine pores smaller than 150 Å and inorganic porous particles of silicon dioxide, titanium oxide, and the like having a surface area of more than 200 m$^2$/g as dispersed densely in layers. However, this particular invention is only intended to prevent the migration of disperse dyes and does not provide sufficient water vapor transmission.

SUMMARY OF THE INVENTION

The present invention has been made in view of such current state of the art and, accordingly, it is an object of the invention to provide coated fabrics having both good water vapor transmission and good waterproofness.

In order to accomplish this object, according to the invention there is provided a water-vapor permeable, waterproof coated fabric having a fibrous base fabric and a porous film formed by coating on one side of the base fabric, the porous film comprising:

a synthetic polymer composed mainly of a polyurethane resin, and a substantially non-porous, inorganic fine powder material having a mean particle diameter of not more than 0.1 μm which is contained in the synthetic polymer in a proportion of more than 1% by weight in terms of dry weight, said porous film having a resistance to water pressure of more than 0.6 kg/cm$^2$ and a water vapor transmission of 6000 g/m$^2$/24 hrs.

The invention will now be described in detail.

The coated fabric according to the invention is produced by a so-called wet coating process in which an inorganic fine powder material is uniformly dispersed in a polar organic solvent solution of a synthetic polymer composed mainly of a polyurethane resin, the resulting uniform dispersion being coated on a base fabric, which coated base fabric is in turn immersed in water thereby to allow a resin film to be formed on the base fabric. Through this process, a fine and highly porous resin coat having high permeability to water vapor is produced on a fibrous fabric which serves as the base fabric, without affecting the inherent waterproofing characteristics of the synthetic polymer composed mainly of a polyurethane resin.

The substantially non-porous, inorganic fine powder material used in the present invention is preferably at least one kind of material selected from the group consisting of silicon compounds, such as silicon dioxide, silicon carbide, and silicon nitride; magnesium compounds, such as magnesium oxide, magnesium hydroxide, and magnesium sulfate; and the like compounds having modified particle surfaces. Above all, a silicon dioxide produced by a dry process is most effective for use as the substantially non-porous inorganic fine powder material.

The particle size of the inorganic fine powder material should be not more than 0.1 μm in terms of means particle diameter and, more preferably, not more than 0.05 μm to provide better effect. A particle diameter of more than 0.1 μm is undesirable because the use of a powder material having such particle diameter will result in that pores in the water vapor permeable film of the coated fabric are excessively large in diameter, which will unfavorably affect the waterproofness of the coated fabric.

For the purpose of using fine silicon dioxide powder as the inorganic fine powder material, such silicon dioxide powder can generally be obtained by using a dry process, such as vapor phase oxidation of silicon halide, combustion hydrolysis of silicon halide, or electric arc process. The fine powder material obtained according to such process, like any other silicon-dioxide fine powder material of the conventional type, has a large number of silanol groups on the surface of each particle and is therefore hydrophilic. Although such fine silicon dioxide powder having a large number of silanol groups on its particle surface can be effectively used alone in the practice of the invention, it is noted that when the hydrophilic fine silicon dioxide powder is uniformly dispersed in a synthetic polymer solution composed mainly of a polyurethane resin, the resin solution tends to become largely thixotropic in its viscosity and is likely to adsorb water, which fact necessitates good control care in coating operation. It is also noted that the resin coat obtained is hydrophilic, which fact is somewhat disadvantageous from the view point of water leakage.

In order to complement these deficiencies, it is effective to use a silicon dioxide fine powder material which has its particle surfaces made hydrophobic by causing the silanol groups to react with trimethylchlorosilane, dimethyldichlorosilane, ethyl alcohol, isopropyl alcohol, or the like material. The use of such hydrophobic fine powder prevents the resin solution from becoming so much thixotropic and involves less moisture adsorption, thus providing for good material stability and good operational advantage.

The silicon dioxide fine powder used in the invention may contain, as an impurity or inclusion, aluminum oxide, magnesium oxide or the like, or any conventional filler, pigment or the like, without any inconvenience involved. The silicon dioxide fine powder used in the invention may contain more than 60% of a silicon dioxide component.

The inorganic fine powder material must be uniformly contained in the resin coat of a synthetic polymer composed mainly of a polyurethane resin, in a proportion of more than 1%, preferably more than 3%. If the proportion is less than 1%, the permeable film on the the coated fabric to be produced would be of a small numbers of porosity, it being thus impractical to obtain high water-vapor transmission.

Fibrous base fabrics suitable for use as such in the present invention include woven fabrics, knitted fabrics, and nonwoven fabrics which are made from polyamide synthetic fibers represented by nylon 6 and nylon 6, 6; polyester synthetic fibers represented by polyethylene terephthalate; polyacrylonitrile synthetic fibers; polyvinyl alcohol synthetic fibers; semisynthetic fibers, such as triacetate; and fiber blends, such as nylon 6/cotton and polyethylene terephthalate/cotton.

For purposes of the present invention, any such fibrous base fabric which has been treated with a water repellent may be used. This serves as a means for preventing the penetration of resin solution into the interior of the base fabric. The water repellent to be used for this purpose may be any repellent of the known type, such as paraffin base repellent, polysiloxane repellent, and fluorine repellent, and such repellent may be applied according to any known method in common use, such as padding and spray coating. In the case where good water repellency is required in particular, repellent treatment may be effected using a fluorine repellent, for example, ASAHI GUARD 730 (a fluorine repellent emulsion, produced by Asahi Garasu Co., Ltd.) in such a manner that padding is effected in a 5% water dispersion of the repellent (with a wet pick-up of 35%), followed by drying, then heat treatment at 160° C. for one minute.

To produce the coated fabric according to the invention, a solution of a synthetic polymer composed mainly of polyurethane resin which includes inorganic fine powder is coated on the fibrous base fabric by using a wet coating process. The term "synthetic polymer composed mainly of polyurethane resin" means a synthetic polymer having a polyurethane content of 50–100%.

This synthetic polymer may include other synthetic polymers, such as polyacrylic acid, polyvinyl chloride, polystyrene, polybutadiene, and polyamino acid, and/or copolymers thereof, within the range of less than 50%. Of course, compounds modified with fluorine, silicon or the like may also be used.

Polyurethane resin is a copolymer produced by causing polyisocyanate and polyol to react with each other. Isocyanate components suitable for use in this connection may be aromatic di-isocyanate, aliphatic di-isocyanate, and alicyclic di-isocyanate, which are used alone or in mixture. More specifically, tolylene 2, 4-diisocyanate, 4, 4'-diphenylmethane diisocyanate, 1, 6-hexane diisocyanate, 1, 4-cyclohexane diisocyanate, etc. are used. Polyol components suitable for use are polyether polyol and polyester polyol. Exemplary polyether polyols include polyethylene glycol, polypropylene glycol, and polytetramethylene glycol. Exemplary polyester polyols are reaction products of diols, such as ethylene glycol and propylene glycol, with dibasic acids, such as adipic acid and sebacic acid. Ring-opening polymers, such as caprolactone, may also be used.

The above mentioned solution of a synthetic polymer composed mainly of polyurethane resin which includes inorganic fine powder may be suitably applied to form a resin coat according to the conventional coating procedure or, for example, by using a knife coater, comma coater, reverse coater, or the like. In order to provide a target water-pressure resistance of more than 0.6 $kg/cm^2$, coating should be effected by controlling the coating weight so that the weight of the resin coat may generally be more than 5 $g/m^2$, preferably more than 10 $g/m^2$, though the required coat weight may vary depending upon the smoothness and permeability (JIS L-1096) of the surface of the fibrous base fabric to be coated.

In the present invention, for purposes of improving the peel resistance of the resin coat relative to the fibrous base fabric, a compound having high affinity for the resin or base fabric may be used in combination. Such compound suitable for use may be isocyanate compound, polyamide resin, polyurethane resin, or polyester resin.

Isocyanate compounds useful for this purpose include 2, 4-tolylene diisocyanate, diphenylmethane diisocyanate, isophorone diisocyanate, hexamethylene diisocyanate, and tri-isocyanates produced by addition reaction of 3 mol of such diisocyanate with 1 mol of a compound having an active hydrogen content (such as trimethylol propane or glycerine). These isocyanates may be of the type having free isocyanate groups or of such a type that the isocyanate is stabilized by addition of methyl ethyl ketoxime or the like and dissociated into blocks by a subsequent heat treatment, either of which types may be suitably used according to the workability requirement and/or intended use.

The proportion of such isocyanate compound in actual use is preferably 0.1 to 10% by weight, more preferably 0.5 to 5% by weight, relative to the quantity of a synthetic polymer composed mainly of polyurethane resin. If the proportion is less than 0.1% by weight, the bond strength of the porous coat relative to the base fabric would be too low, while if the proportion is more than 10%, the handle of the coated fabric would be unfavorably affected because that would tend to stiffen the handle.

Useful polyamide resins include, for example, nylon 6, nylon 6, 6, nylon 6, 10; aliphatic polyamides in which the hydrogen of amide groups of nylon is methoxymethylated, such as N-methoxymethyl 6, 6 nylon; and dimer acid polyamides as represented by Versamid (trade name).

Useful polyurethane resins include polyether polyol, polyester polyol, various kinds of grafted polyols, polyol halide, polyols having a diene chain, polycarbonate polyol, acryl polyol, etc. Mention may also be made of polymerization reaction products of polyol with isocyanates, such as tolylene diisocyanate, diphenylmethane diisocyanate, polymecdiphenylmethane diisocyanate, and hexamethylene diisocyanate. In some case, diamines or the like may be used as crosslinkers or chain extenders.

Useful polyester resins include polymerization reaction products of diols, such as ethylene glycol, diethylene glycol, propylene glycol, 1, 4-butanediol, 1, 6-hexanediol, and polytetramethylene glycol, with aromatic and/or aliphatic dicarboxylic acids, such as isophthalic acid, terephthalic acid, adipic acid, and sebacic acid, and ring-opening polymeric products. such as lactone. The diol component and acid component are selected so that the resulting polymer may be amorphous and so that they can be dissolved in a polar organic solvent. For example, a polyester having a molecular weight of 20,000 to 30,000 as produced by polymerization of terephthalic acid and sebacic acid as acid components and ethylene glycol and neopentyl glycol as diol components can be advantageously used.

The proportion of these polyamide, polyurethane and polyester resins is 5 to 100% by weight, preferably 5 to 50% by weight, relative to the quantity of the synthetic polymer composed mainly of polyurethane resin. If the proportion is less than 5%, the bond strength of the resin relative to the fibrous base fabric would be insufficient, and conversely if the proportion is more than 100%, the handle of the coated fabric would be hard, or the resin coat would be likely to become deformed by heating, or the permeability of the coat would be unfavorably lowered.

In the present invention, after the resin solution of a synthetic polymer composed mainly of polyurethane is coated on the fibrous fabric, the coated fibrous fabric is immersed in water at 0° to 30° C. for 0.5 to 10 min. in order to wet-coagulate the resin content thereof. Then, the coated fabric is washed in warm water at 40° to 60° C. for 5 to 15 min, and then dried in a conventional manner.

In the present invention, for purposes of further improving the waterproofness, after wet coating, a repellent treatment may be given to the coated fabric. For repellent treatment, the known repellent treating procedure in common practice may be employed. The water-vapor permeable, waterproof coated fabric in accordance with the invention has unrivaled permeability characteristics which, if sacrificed to a certain degree, are still far much higher than the permeability level of any known coated fabric. Therefore, if it is desired to further improve the waterproof performance of coated fabric, a non-porous polyurethane resin coat having a dry thickness of the order of 0.5 to 2 μm may be formed on the wet-formed resin coat. By so doing it is possible to obtain a highly permeable coated fabric having high waterproof performance as well. As a result, the coat layers have high resistance to water pressure and, therefore, the coat layers, though very thin, can have a synergistic effect in improving the waterproof performance, without any apprecial loss in permeability.

The coated fabric according to the invention has a resin coat formed of a synthetic polymer composed mainly of a polyurethane resin in which are present substantially non-porous, inorganic fine powder particles having a mean particle diameter of not more than 0.1 μm, whereby the coated fabric can exhibit excellent water vapor transmission and excellent waterproofness. It is not theoretically clear why the presence of inorganic fine powder particles having a mean particle diameter of not more than 0.1 μm can provide a combination of good water vapor transmission and good waterproofness, but the present inventors may explain the reson as follows.

As a synthetic polymer solution of a polyurethane resin base in which are uniformly dispersed substantially non-porous, inorganic fine powder particles having a mean particle diameter of not more than 0.1 μm is coated on the base fabric, with the resin coat being wet-coagulated, the polyurethane resin begins to form a characteristic porous structure of the resin, that is, a honeycomb skin core structure having a pore size of 1 to 20 μm as viewed in the direction of resin coat thickness. Simultaneously, a delicate gap in coagulation speed occurs at an interface between inorganic powder particles and the coagulating resin because inorganic powder particles are uniformly micro-dispersed in the solution. It is conjectured that this leads to the formation of a multiplicity of fine pores having a pore size of not more than 0.1 μm which can provide for substantial improvement in water vapor transmission, without deteriorating the waterproof characteristics of the resin coat.

Since the fine pores formed in the resin coat provide considerable improvement in water vapor transmission, the present invention also provides an effective solution to the problem of water leak, a problem peculiar to highly permeable, waterproof fabrics, which may often be encountered when pressure is applied on the fabric while in use. Further, according to the invention, inorganic fine powder particles are uniformly present throughout the entire resin coat, from the surface layer to the bottom layer, and this eliminates the slimy feel peculiar to polyurethane resins on the surface of the resin coat, thus providing a dry touch and, in addition, improved abrasion resistance and bond strength with respect to the entire resin coat.

Furthermore, according to the present invention, it is possible to arrange that the porous film formed of a synthetic polymer composed mainly of a polyrethane resin contains lamelliform powder particles, a reaction product of L-lysine with an organic acid, in the amount of more than 1.0% by weight. In this case, too, when producing a water-vapor permeable, waterproof fabric in accordance with the invention, particles of a lamelliform powder material, a reaction product of L-lysine with an organic acid, should be uniformly dispersed in a polar organic solvent solution of a synthetic polymer composed mainly of a polyurethane resin, and the resulting liquid should be applied using the so-called wet coating process.

Reaction products of L-lysine with organic acids which are useful in this connection include those produced through reaction of L-lysine with organic acids, such as propionic acid, butyric acid, isobutyric acid, pentanoic acid, hexanoic acid, heptanoic acid, octanoic acid, succinic acid, adipic acid, fumaric acid, maleic acid, phthalic acid, myristic acid, palmitic acid, stearic acid, oleic acid, linoleic acid, lauric acid, and linolenic acid. Above all, L-lysine-alginic acid reaction products are preferred because of their particular characteristics. More especially, N ε-lauroyl-L-lysine is particularly effective.

The lamelliform powder material referred to herein is a white, crystalline powder material having a lengthwise dimension to thicknesswise dimension ratio of not more than 3:1 and can be pulverized by grinding. Usually, such powder material having a particle size of not more than 50 μm lengthwise and not more than 10 μm thicknesswise is preferred for use. The proportion of the lamelliform powder material in actual use may be determined suitably according to the end use of the coated fabric to be produced, but usually particles of the powder material may be uniformly dispersed in the water-vapor permeable resin in an amount of more than 0.1% by weight.

The water-vapor permeable, waterproof coated fabric as described above has a resin coat formed of a synthetic polymer composed mainly of a polyurethane resin in which are present substantially non-porous silicon dioxide fine powder particles having a mean diameter of not more than 0.1 μm and particles of a lamelliform powder material, a reaction product of L-lysine with an organic acid whereby the coated fabric can exhibit high abrasion resistance and excellent water vapor transmission and waterproofness. Although it is not theoretically clear why the coated fabric of the invention can exhibit both such abrasion resistance and such permeable and yet waterproof performance, the present inventors may explain the reason as follows.

As a synthetic polymer solution of a polyurethane resin base in which are uniformly dispersed substantially non-porous silicon dioxide fine powder particles having a mean particle diameter of not more than 0.1 μm and particles of a lamelliform powder material, a reaction product of L-lysine with an organic acid is coated on the fibrous base fabric, with the resin coat being wet-coagulated, the polyurethane resin begins to form a characteristic porous structure of the resin in the same manner as earlier described. Simultaneously, a delicate gap in coagulation speed occurs at an interface between fine silicon dioxide particles uniformly dispersed in the resin and the coagulating resin, and this leads to the formation of a multiplicity of fine pores having a pore size of not more than 1 μm which can provide for substantial improvement in water vapor transmission, without deteriorating the waterproof characteristics of the resin coat. Moreover, particles of the lamelliform powder material, as a reaction product of L-lysine with an organic acid, by nature tend to align in parallel and in layers, wherever possible, as viewed in the direction of coating, and have good lubricity and good cleavage characteristics; therefore they tend to peel in the form of a very thin layer when worn. It is conjectured that this fact explains the reason for high resistance to abrasion.

In the coated fabric of the invention, particles of a lamelliform powder material having good lubricating properties which is a reaction product of L-lysine with an organic acid, and in combination therewith, finely divided silicon dioxide particles are uniformly present throughout the entire resin coat, from the surface layer thereof and to the bottom layer. Thus, through their synergistic effect, improved abrasion resistance and, in addition, good resistance to washing, etc. are obtained. The surface of the resin coat is free from such slimy feel as is peculiar to polyurethane resins and gives some dry touch. Furthermore, the water-vapor permeable, waterproof coated fabric according to the invention has, in addition to such high abrasion resistance, improved permeability to water vapor because of the presence of fine pores of not more than 1 μm; therefore, the coated fabric can prove to be very effective against the trouble of water leak that may often occur with highly permeable waterproof fabrics in particular when pressure is applied while being worn, or when some dynamic energy is applied together with pressure.

According to the invention, it is possible to obtain coated fabrics having excellent moisture permeability and waterproofness. Further, the coated fabric according to the invention has high abrasion resistance and high peel resistance with respect to its resin coat. According to the invention, it is possible to provide high performance quality in both water vapor transmission and waterproofness only through a wet coating process. Therefore, the invention permits low cost production of coated fabrics and provides good industrial advantages. By virtue of its excellent performance characteristics, the coated fabric of the invention is particularly suited for use in various apparel applications, such as raincoat, outer garment, military uniform, and sportswear.

DESCRIPTION OF THE EMBODIMENTS

Figure 1:
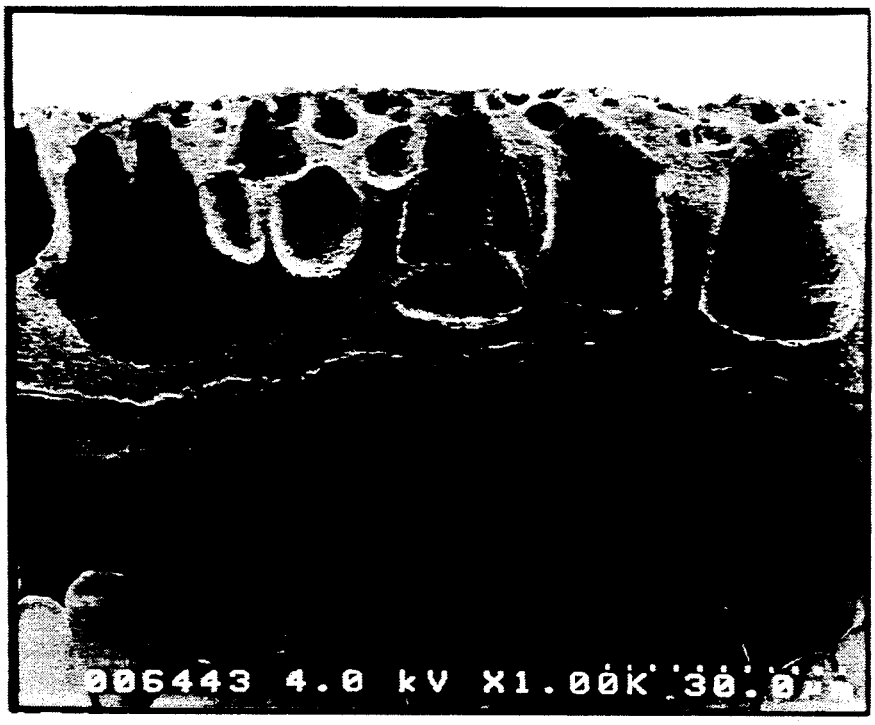
FIG. 1 is a photographic view in section showing a fine porous film of a water-vapor permeable, waterproof coated fabric of the invention as produced in Example 3 which will be explained later, taken at 1,000× magnification by a scanning electron microscope.

The present invention will be described in further detail with respect to several examples. In Examples 1 and 2 given below, measurement of coated-fabric performance characteristics was carried out according to the following methods.

(1) Water pressure resistance:
JIS L-1092 (High Water Pressure Method)
(2) Water Vapor Permeability:
JIS L-1099 (A-1 Method)
(3) Water Leakiness:

Bundesman Method (reference test method in L-1092).

Water leakage was measured 60 min after.

(4) Abrasion Resistanc:

JIS L-1084 (A-1 Method)

(5) Peeling Strength:

Measurement was made according to JIS L-1089, with a hot melt tape placed warpwise in adhesion contact with the coat surface.

EXAMPLE 1

A plain fabric having a warp density of 120 end/inch and a weft density of 90 picks/inch was woven using a nylon high multifilament of 70 denier, 68 filaments, and same was scoured and dyed (with acid dye Diacid Fast Red 3BL 2% owf, Mitsubishi Kasei Co., Ltd.) according to conventional procedures. Then, the fabric was subjected to padding (wet pick-up: 35%) with a 5% aqueous solution of a fluorine-type relellent emulsion "ASAHI GUARD 710" (made by Asahi Garasu Co., Ltd.). After drying, heat treatment was carried out at 160° C. for 1 min. Then, calendering was carried out with the fabric by employing a calendering machine having mirror finish rolls, under the conditions of: temperature 170° C., pressure 30 kg/cm$^2$, and velocity 20 m/min. Thus, a base fabric ready for coating was obtained.

Subsequently, a polyurethane resin solution of such composition as is shown in the following formulation 1 and having a solid content concentration of 25% was coated on the calendered surface of the base fabric at a unit coat weight of 80 g/m$^2$ using a knife over-roll coater. Immediately thereafter, the coated base fabric was immersed in water at 15° C. for 1 min to coagulate the resin content of the coat. Then, the fabric was washed in warm water of 50° C. for 10 min, then dried. Thus, a resin coat containing 11% of inorganic fine powder particles was formed.

| Formulation | |
|---|---|
| 100 parts | RESAMINE CU-4550 (ester type polyurethane resin, Dainichi Seika Kogyo Kabushiki Kaisha) |
| 1 part | RESAMINE X (isocyanate compound, Dainichi Seika Kogyo Kabushiki Kaisha) |
| 25 parts | N,N-dimethylformamide |
| 3 parts | AEROSIL #130 ($SiO_2$ powder having a mean particle diameter of 0.016 μm, made by Nippon Aerosil Kabushiki Kaisha) |

Nextly, for water repellent treatment, the surface of the resin coat was gravure-coated with a 5% aqueous solution of ASAHI GUARD 710, a water repellent, (15 g/m$^2$) using a gravure coater. After drying, heat treatment was effected at 160° C. for 1 min. Thus, a coated fabric in accordance with the invention was obtained.

For purposes of comparison with the invention, a reference coated fabric (Reference Example 1) was produced in same way as in Example 1, except that AEROSIL #130 was excluded from Formulation 1 in Example 1. Again, for purposes of comparison with the invention, a reference coated fabric (Reference Example 2) was produced in same way as in Example 1, except that Nipsil VN3(a wet process, finely divided porous $SiO_2$ powder having a mean particle diameter of 0.016 μm, made by Nippon Silica Kogyo Co., Ltd.) was used in place of AEROSIL #130 in Formulation 1 in Example 1, but in same quantity.

Measurements and evaluation were made of respective performance characteristics of the coated fabrics of Example 1 and Reference Examples 1, 2. The results are shown together in Table 1.

TABLE 1

| | Example 1 | Ref. Exp. 1 | Ref. Exp. 2 |
|---|---|---|---|
| Water pressure resistance kg/cm$^2$ | 1.12 | 1.09 | 0.96 |
| Moisture Permeability g/m$^2$/24 hrs | 9030 | 3310 | 4340 |
| Water leakiness cc | 0 | 0 | 0 |
| Abrasion resistance grade | 3–4 | 1–2 | 2 |
| Peeling strength g/inch | 2190 | 1240 | 1470 |

As clear from Table 1, the coated fabric according to the invention has higher water pressure resistance and higher permeability, and is very effective against the trouble of water leak which has been commonly found with conventional highly permeable, waterproof fabrics. Further, the coated fabric of the invention is found satisfactory in respect of abrasion resistance and peel resistance.

EXAMPLE 2

A coated fabric according to the invention was produced in the same way as in Example 1 except that the following formulation 2 for coating solution was employed in place of Formulation 1 in Example 1. Thus, we obtain a resin layer containing 17% of inorganic fine powder particle.

| Formulation 2 | |
|---|---|
| 75 parts | RESAMINE CU-4550 (ester type polyurethane resin, Dainichi Seika Kogyo Co., Ltd.) |
| 25 parts | PAU-3 (polyamino acid urethane resin, Mitsubishi Kasei Co., Ltd.) |
| 1 part | RESAMINE X (isocyanate compound, Dianichi Seika Kogyo Co., Ltd.) |
| 25 parts | N,N-dimethylformamide |
| 5 parts | Magnesia 100 B (MgO fine powder having a mean particle diameter of 0.01 to 0.02 μm, Ube Chemical Industries Co., Ltd.) |

For purposes of comparison with this Example 2, a reference coated fabric (Reference Example 3) was produced in same way as in Example 2, except that Magnesia 100 B was excluded from Formulation 2 in Example 2.

Measurements and evaluation were made of respective performance characteristics of the coated fabrics of Example 2 and Reference Example 3. The results are shown together in Table 2.

TABLE 2

| | Example 2 | Ref. Exp. 3 |
|---|---|---|
| Water pressure resistance kg/cm$^2$ | 0.85 | 0.84 |
| Permeability g/m$^2$/24 hrs | 8970 | 5900 |
| Water leakiness cc | 0 | 0 |
| Abrasion resistance grade | 3–4 | 1–2 |
| Peeling strength g/inch | 1970 | 1190 |

As is clear from Table 2, the coated fabric of Example 2 has higher water pressure resistance and higher permeability, and is very effective against the trouble of water leak which is commonly found with conventional highly permeable, waterproof fabrics. Further, the coated fabric of the invention is found satisfactory in respect of abrasion resistance and peel resistance.

EXAMPLE 3

In examples 3 and 4 below, measurement of performance characteristics of coated fabrics was made according to the following methods.

(i) Water pressure resistance:
JIS L-1092 (High Water Pressure Method)
(ii) Water Vapor Permeability:
JIS L-1099 (A-1 Method)
(iii) Water Leakiness:
Bundesman Method (reference test method in L-1092).
Water leakage was measured 120 min after, and the condition of the resin coat surface after water penetration was observed.
(iv) Abrasion Resistance:
JIS L-1084 (A-1 Method)
(v) Peeling Strength:
Measurement was made according to JIS L-1089, with a hot melt tape placed warpwise in adhesion contact with the coat surface.

In this Example 3, a plain fabric having a warp density of 120 ends/inch and a weft density of 90 picks/inch was woven using a nylon high multifilament of 70 denier, 68 filaments, and same was scoured and dyed (with acid dye Diacid Fast Red 3BL 2% owf, Mitsubishi Kasei Kabushiki Kaisha) according to conventional procedures. Then, the fabric was subjected to padding (wet pick-up: 35%) with a 5% aqueous solution of a fluorine-type water repellent emulsion "ASAHI GUARD 710" (made by Asahi Garasu Co., Ltd.). After drying, heat treatment was carried out at 160° C. for 1 min. Then, calendering was carried out with the fabric by employing a calendering machine having mirror finish rolls, under the conditions of: temperature 170° C., pressure 30 kg/ $cm^2$, and velocity 20 m / min. Thus, a base fabric ready for coating was obtained.

Then, a polyurethane resin solution of such composition as is shown in the following formulation 3 and having a solid content concentration of 25% was coated on the calendered surface of the base fabric at a unit coat weight of 80 g/$m^2$ using a knife over-roll coater. Immediately thereafter, the coated base fabric was immersed in water at 15° C. for 40 sec. to coagulate the resin content of the coat. Subsequently, the fabric was washed in warm water of 50° C. for 10 min, then dried. Thus, a resin coat containing 11% of silicon dioxide fine powder particles was formed.

| Formulation 3 | |
|---|---|
| 100 parts | RESAMINE CU-4550 (ester type polyurethane resin, Dainichi Seika Kogyo Co., Ltd.) |
| 1 part | RESAMINE X (isocyanate compound, Dainichi Seika Kogyo Co., Ltd.) |
| 25 parts | N,N-dimethylformamide |
| 3 parts | AEROSIL R-974 (hydrophobic silicon dioxide fine powder having a mean particle diameter of 0.01 μm, made by Nippon Aerosil Co., Ltd.) |

Nextly, for water repellent treatment, the surface of the resin coat was gravure-coated with a 5% aqueous solution of ASAHI GUARD 710, a water repellent, (15 g/$m^2$ ) using a gravure coater. After drying, heat treatment was effected at 160° C. for 1 min. Thus, a coated fabric of Example 3 was obtained.

For purposes of comparison with the present Example 3, a reference coated fabric (Reference Example 4) was produced in same way as in Example 3, except that AEROSIL R-974 was excluded from Formulation 3 in example 3. Again, for purposes of comparison with Example 3, a reference coated fabric (Reference Example 5) was produced in same way as in Example 3, except that 5 parts of a ground product of Kieselgel 60G ($SiO_2.nH_2O$ fine powder having a particle diameter of 1-10 μm, made by MERCK) were used in place of AEROSIL R-974 in Formulation 3 in example 3 to form a resin coat having a 17% content thereof.

Measurements and evaluation were made of respective performance characteristics of the coated fabrics of Example 3 and Reference Examples 4, 5. The results are shown together in Table 3.

TABLE 3

| | Example 3 | Ref. Exp. 4 | Ref. Exp. 5 |
|---|---|---|---|
| Water pressure resistance kg/$cm^2$ | 1.23 | 1.19 | 0.51 |
| Moisture Permeability g/$m^2$/24 hrs | 9760 | 2940 | 3920 |
| Water leakiness | | | |
| Leakage cc | 0 | 0 | 0 |
| Resin coat surface condition | normal | normal | generally discolored |
| Abrasion resistance grade | 3-4 | 1-2 | 2 |
| Peeling strength g/inch | 1960 | 1090 | 1130 |

As is clear from Table 3, the coated fabric of Example 3 has higher water pressure resistance and higher permeability. The use of hydrophobic silicon dioxide fine powder has proved to be very effective against the trouble of water leak which has been commonly found with conventional highly permeable, waterproof fabrics. Further, the coated fabric of Example 3 is found satisfactory in respect of abrasion resistance and peel resistance.

Figure 2:
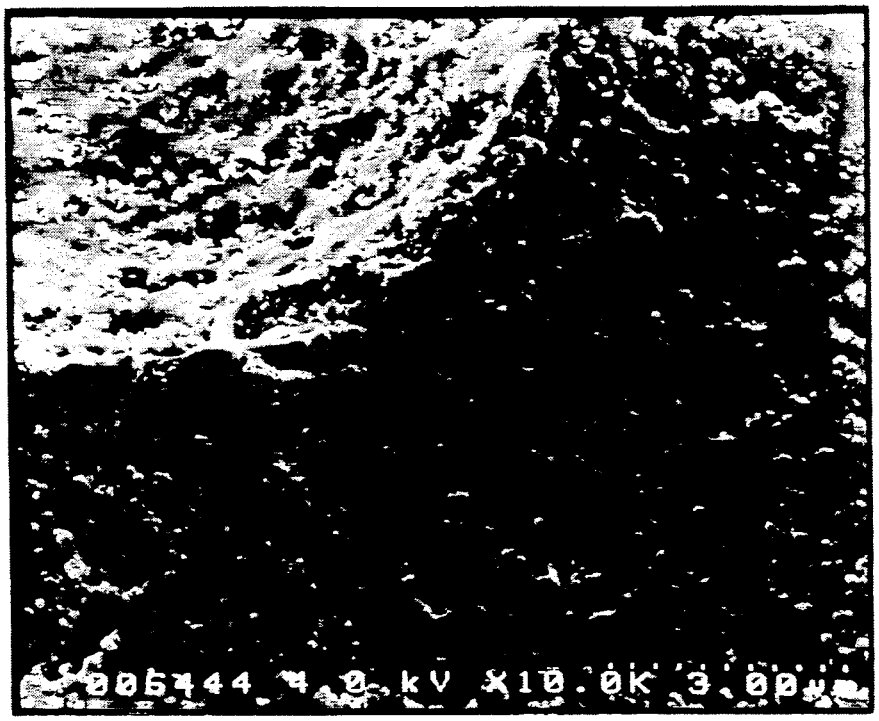
FIG. 2 is a similar photographic view in section showing a fine porous film of a water-vapor permeable, waterproof coated fabric of the invention as produced in Example 3, taken at 10,000× magnification by a scanning electron microscope.
Figure 3:
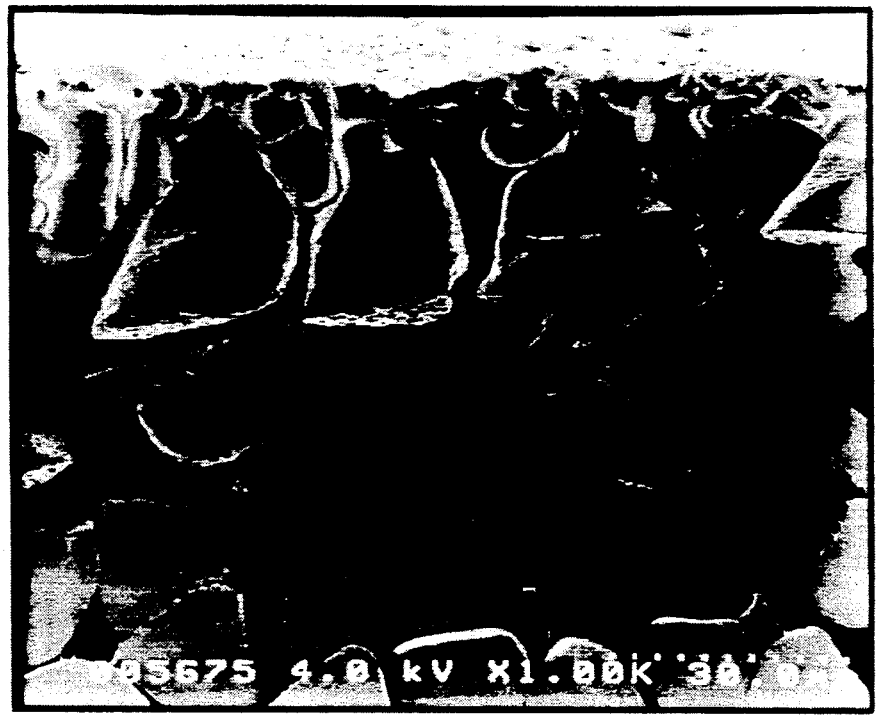
FIG. 3 is a photographic view in section showing a coat film of a reference coated fabric as produced in Reference Example 4 which will be explained later, taken at 1,000× magnification by a scanning electron microscope.

For reference, resin coats formed will be explained with reference to the accompanying photographic cross sectional views. FIGS. 1 and 2 are photographic views showing in cross section the fine porous films formed on the surface of a permeable waterproof coated fabric according to the invention, as taken at 1,000× magnification and 10,000× magnification respectively by a scannig electron microscope. FIG. 3 is a photographic view showing in section of the polyurethane coat formed on the coated fabric of Reference Example 4 which contains no silicon dioxide powder, as taken at 1,000× magnification by the scannig electron microscope. As may be clearly understood from a comparison of FIGS. 1 and 2 with FIG. 3, a multiplicity of fine pores, each of not more than 1 μm, are found on the surface of the Example 3 permeable, waterproof coated fabric, which tells that the fabric is highly permeable to water vapor. In unfavorable contrast with this, FIG. 3 photograph representing Reference Example 4 shows no fine pore at all, and therefore the permeability of the Reference Example 4 coated fabric is of an extremely low level.

Generally, when a permeable waterproofing urethane resin is applied and wet formed into a resin coat, fine holes in the resin coat present such a honeycomb skin core structure as shown in FIG. 3 in the section-wise (thickness-wise) direction. According to the present example, the resin coat has such a honeycomb skin core structure having a pore size of 1 to 20 μm as shown in FIG. 1, when viewed in the thickness-wise direction and further has ultrafine pores of not more than 1 μm. This prevents a decrease in the water pressure resistance and. at same time, provides for improvement in the permeability characteristics.

EXAMPLE 4

A coated fabric according to the invention was produced moisture permeable, waterproof coated fabric (Example 4) in same way as in Example 3 except that AEROSIL #200 (a hidrophilic silicon dioxide powder having a mean particle diameter of 0.012 μm, made by Nippon Aerosil Co., Ltd.) was used in place of AEROSIL R-974 in the formulation 3 of Example 3, but in same quantity.

For purposes of comparison with the present Example 4, a reference coated fabric (Reference Example 6) was produced in same way as in Example 4, except that AEROSIL #200 was excluded from the formulation for coating resin solution in Example 4. Again, for purposes of comparison with Example 4, a reference coated fabric (Reference Example 7) was produced in same was as in this Example 4 except that 5 parts of a ground product of Kieselgel 60G ($SiO_2.nH_2O$ fine powder having a particle diameter of 1-10 μm, made by MERCK) were used in place of AEROSIL #200 in the formulation for coating resin solution in Example 4 to form a resin coat having a 17% content thereof.

Measurements and evaluation were made of respective performance characteristics of the coated fabrics of Example 4 and Reference Examples 6, 7. The results are shown together in Table 4.

TABLE 4

| | Example 4 | Ref. Exp. 6 | Ref. Exp. 7 |
|---|---|---|---|
| Water pressure resistance kg/cm$^2$ | 1.14 | 1.20 | 0.50 |
| Moisture Permeability g/m$^2$/24 hrs | 8790 | 2950 | 3920 |
| Water leakiness | | | |
| Leakage cc | 0 | 0 | 3.7 |
| Resin coat surface condition | slightly discolored | normal | generally discolored |
| Abrasion resistance grade | 3-4 | 1-2 | 2 |
| Peeling strength g/inch | 1870 | 1080 | 1120 |

As is clear from Table 4, the coated fabric of Example 4 has higher water pressure resistance and higher permeability. It is also satisfactory in water leakiness, abrasion resistance and peel resistance.

EXAMPLE 5

In Examples 5 and 6 below, measurement of performance characteristics of coated fabrics was made according to the following methods.

(a) Water pressure resistance:

JIS L-1092 (High Water Pressure Method)

(b) Water Vapor Permeability:

JIS L-1099 (A-1 Method)

(c) Water Leakiness:

Bundesman Method (reference test method in L-1092). Water leakage was measured 480 min after, and the condition of the resin coat surface after water penetration was observed.

(d) Abrasion Resistance:

1000-times and 5000-times abrasion tests were carried out according to JIS L-1084, A-1 Method. 45 R.

In this Example 5, a plain fabric having a warp density of 120 ends/inch and a weft density of 90 picks/inch was woven using a nylon high multifilament of 70 denier, 68 filaments, and same was scoured and dyed (with acid dye Diacid Fast Red 3BL 2% owf, Mitsubishi Kasei Kabushiki Kaisha) according to conventional procedures. Then, the fabric was subjected to padding (wet pick-up: 35%) with a 5% aqueous solution of a fluorine-type water repellent emulsion "ASAHI GUARD 710" (made by Asahi Garasu Co., Ltd.). After drying, heat treatment was carried out at 160° C. for 1 min. Then, calendering was carried out with the fabric by employing a calendering machine having mirror finish rolls, under the conditions of: temperature 170° C., pressure 30 kg/cm$^2$, and velocity 20 m/min. Thus, a base fabric ready for coating was obtained.

Then, a polyurethane resin solution of such composition as is shown in the following formulation 4 and having a solid content concentration of 25% was coated on the calendered surface of the base fabric at a unit coat weight of 80 g/m$^2$ using a knife over-roll coater. Immediately thereafter, the coated base fabric was immersed in water at 15° C. for 40 sec. to coagulate the resin content of the coat. Subsequently, the fabric was washed in warm water of 50° C. for 10 min, then dried. Thus, a resin coat containing 10% by weight of silicon dioxide fine powder particles and 7% by weight of Nε-lauroyl-L-lysine powder was formed.

| Formulation 4 | |
|---|---|
| 100 parts | RESAMINE CU-4550 (ester type polyurethane resin, Dainichi Seika Kogyo Co., Ltd.) |
| 1 part | RESAMINE X-100 (isocyanate compound, Dainichi Seika Kogyo Co., Ltd.) |
| 30 parts | N,N-dimethylformamide |
| 3 parts | AEROSIL R-974 (hydrophobic silicon dioxide fine powder having a mean particle diameter of 0.012 μm, made by Nippon Aerosil Co., Ltd.) |
| 2 parts | N ε-lauroyl-L-lysine |

Nextly, for water repellent treatment, the surface of the resin coat was gravure-coated with a 5% aqueous solution of ASAHI GUARD 710, a water repellent, using a gravure coater. After drying, heat treatment was effected at 160° C. for 1 min. Thus, a moisture permeable, waterproof coated fabric of Example 5 was obtained.

For purposes of comparison with the present Example 5, a reference coated fabric (Reference Example 8) was produced in same way as in Example 5, except that Nε-lauroyl-L-lysine was excluded from Formulation 4 in Example 5. Again, for purposes of comparison with Example 5, a reference coated fabric (Reference Example 9) was produced in same way as in Example 5, except that AEROSIL R -974 was excluded from Formulation 4 in Example 5. Further again, for purposes of comparison with Example 5, a reference coated fabric (Reference Example 10) was produced in same way as in Example 5, except that Nε-lauroyl-L-lysine and AEROSIL R-974 were both excluded from Formulation 4 in Example 5.

Measurements and evaluation were made of respective performance characteristics of the coated fabrics of Example 5 and Reference Examples 8, 9 and 10. The results are shown together in Table 5.

TABLE 5

| | Exp. 5 | Reference Example 8 | 9 | 10 |
|---|---|---|---|---|
| Water pressure resistance kg/cm$^2$ | 1.27 | 1.29 | 1.25 | 1.30 |
| Moisture Permeability g/m$^2$/24 hrs | 9540 | 9610 | 2960 | 2980 |
| Water Leakiness | | | | |
| Leakage (cc) | 0 | 0 | 0 | 0 |
| Resin coat surface condition | normal | normal | normal | normal |
| Abrasion resist (grade) | | | | |
| 1000 times | 5 | 3-4 | 5 | 1-2 |
| 5000 times | 3 | 1-2 | 3 | 1 |

As is clear from Table 5, the coated fabric of Example 5 has higher water pressure resistance and higher permeability. The use of hydrophobic silicon dioxide fine powder has proved to be very effective against the trouble of water leak which has been commonly found with conventional highly permeable, waterproof fabrics.

EXAMPLE 6

A permeable waterproof coated fabric according to the invention was produced in same way as in Example 5 except that AEROSIL #200 (a hidrophilic silicon dioxide powder having a mean particle diameter of 0.012 μm, made by Nippon Aerosil Co., Ltd.) was used in place of AEROSIL R -974 in the formulation of Example 5, but in same quantity.

For purposes of comparison with the present Example 6, a reference coated fabric (Reference Example 11) was produced in same way as in Example 6, except that Nϵ-lauroyl-L-lysine was excluded from the formulation 4 for coating resin in Example 6. Also, a reference coated fabric (Reference Example 12) was produced in same way as in Example 6, except that AEROSIL #200 was excluded from the formulation 4 for coating resin solution in Example 6. Again, a reference coated fabric (Reference Example 13) was produced in same way as in this Example 6 except that Nϵ-lauroyl-L-lysine and AEROSIL #200 were both excluded from the formulation 4 for coating resin in Example 6.

Measurements and evaluation were made of respective performance characteristics of the coated fabrics of Example 6 and Reference Examples 11, 12, 13. The results are shown together in Table 6.

TABLE 6

| | Exp. 6 | Reference Example 11 | 12 | 13 |
|---|---|---|---|---|
| Water pressure resistance kg/cm$^2$ | 1.23 | 1.21 | 1.27 | 1.29 |
| Moisture Permeability g/m$^2$/24 hrs | 8990 | 9020 | 2950 | 2990 |
| Water Leakiness | | | | |
| Leakage (cc) | 0 | 0 | 0 | 0 |
| Resin coat surface condition | slightly discolored | slightly discolored | normal | normal |
| Abrasion resistance grade | | | | |

TABLE 6-continued

| | Exp. 6 | Reference Example 11 | 12 | 13 |
|---|---|---|---|---|
| 1000 times | 5 | 3 | 5 | 1-2 |
| 5000 times | 3 | 1-2 | 3 | 1 |

As is apparent from Table 6, the coated fabric of Example 6 has good abrasion resistance and high moisture permeability/waterproofness, and yet is generally satisfactory in water leak characteristics.

What is claimed is:

1. A water-vapor permeable, waterproof coated fabric having a fibrous base fabric and a porous film formed by coating on one side of the base fabric, said porous film comprising:

a synthetic polymer composed mainly of a polyurethane resin, and a substantially non-porous, inorganic fine powder material having a mean particle diameter of not more than 0.1 μm which is contained in the synthetic polymer in a proportion of more than 1% by weight in terms of dry weight, said porous film having a resistance to water pressure of more than 0.6 kg/cm$^2$ and a water vapor transmission of more than 6000 g/m$^2$/24 hours.

2. The fabric according to claim 1, wherein the inorganic fine powder material is silicon dioxide fine powder.

3. The fabric according to claim 1, wherein thicknesswise oriented fine pores of the porous film have an honeycomb skin core structure of 1 to 20 μm in diameter and have a multiplicity of ultrafine pores each having a diameter of not more than 1 μm.

4. The fabric according to claim 1, wherein the porous film contains more than 0.1% by weight of a lamelliform powder material which is a reaction product of L-lysine with an organic acid in a proportion in dry weight of more than 0.1% by weight relative to the synthetic polymer composed mainly of a polyurethane resin.

5. The fabric according to claim 1, wherein the porous film contains a compound having high affinity for the fibrous base fabric.

6. The fabric according to claim 5, wherein the compound having high affinity is a material selected from the group consisting of isocyanate compounds, polyamide resins, polyurethane resins, and polyester resins, or a suitable mixture thereof.

7. The fabric according to claim 1, further comprising a non-porous film formed on the porous film which is formed of a synthetic polymer composed mainly of a polyurethane resin, said fabric having a water pressure resistance of more than 1 kg/cm$^2$ and a water-vapor permeability of more than 4000 g/m$^2$/24 hrs.

8. The fabric according to claim 1, wherein the fibrous base fabric is a water-repellent treated fabric.

9. A method of manufacturing a moisture permeable and waterproof coated fabric comprising the steps of coating on a fibrous base fabric a solution of a synthetic polymer formed mainly of a polyurethane resin which contains, relative to the solid content of the resin, more than 1% by weight of substantially non-porous inorganic fine powder particles having a mean particle diameter of not more than 0.1 μm, and then immersing the coated base fabric in water to wet coagulate the resin content thereof.

* * * * *